US009956674B2

(12) United States Patent
Hargrove et al.

(10) Patent No.: US 9,956,674 B2
(45) Date of Patent: May 1, 2018

(54) REPLACEMENT TOOL FOR DRIVESHAFT YOKE BUSHINGS

(71) Applicant: FORD GLOBAL TECHNOLOGIES, LLC, Dearborn, MI (US)

(72) Inventors: Curtis M. Hargrove, Detroit, MI (US); Robert B. Sunde, Macomb, MI (US); Mark E. Urbaniak, Ypsilanti, MI (US); Scott Blevins, Britton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 303 days.

(21) Appl. No.: 15/006,418

(22) Filed: Jan. 26, 2016

(65) Prior Publication Data

US 2017/0209994 A1 Jul. 27, 2017

(51) Int. Cl.

| | |
|---|---|
| ***B25B 27/28*** | (2006.01) |
| ***B25B 27/02*** | (2006.01) |
| *B25B 27/06* | (2006.01) |

(52) U.S. Cl.

CPC ..... *B25B 27/28* (2013.01); *B25B 27/023* (2013.01); *B25B 27/02* (2013.01); *B25B 27/062* (2013.01); *Y10T 29/49822* (2015.01); *Y10T 29/53796* (2015.01); *Y10T 29/53857* (2015.01); *Y10T 29/53861* (2015.01); *Y10T 29/53883* (2015.01)

(58) Field of Classification Search

CPC ..... B25B 27/023; B25B 27/062; B25B 27/28; B25B 27/02; Y10T 29/53848; Y10T 29/53861; Y10T 29/49822; Y10T 29/53883

USPC ..... 29/256, 264, 259, 255, 278

See application file for complete search history.

(56) References Cited

U.S. PATENT DOCUMENTS

| | | | | |
|---|---|---|---|---|
| 2,736,955 | A | 3/1956 | Fuglie | |
| 6,212,775 | B1 | 4/2001 | Sarver et al. | |
| 6,539,601 | B1 | 4/2003 | Cloward | |
| 6,591,469 | B1 | 7/2003 | Morin | |
| 6,601,277 | B1 * | 8/2003 | Swanson | B25B 27/023 29/256 |
| 7,818,860 | B2 | 10/2010 | Hume et al. | |
| 8,186,031 | B2 | 5/2012 | Whitney et al. | |

(Continued)

FOREIGN PATENT DOCUMENTS

EP 1208948 A2 5/2002

*Primary Examiner* — Christopher M Koehler
*Assistant Examiner* — Mahdi H Nejad
(74) *Attorney, Agent, or Firm* — James Dottavio; MacMillan, Sobanski & Todd, LLC

(57) ABSTRACT

A replacement tool removes an old bushing or installs a new bushing in a driveshaft yoke. A fixture has a guide chamber facing a bushing bore and a first threaded passage. A traveler mounted in the fixture has a plunger received in the guide chamber and a socket that holds the bushing. The plunger has a second threaded passage aligned with the first passage and having a smaller diameter. A set screw can lock the bushing into the socket. A removal bolt with a shaft matching the second passage is inserted through both passages. Turning of the removal bolt retracts the traveler and extracts the bushing. The tool is reconfigured with an installation bolt in the first passage only. A push plug is placed in the guide chamber to transfer force from the installation bolt to the plunger during turning of the installation bolt to press fit a new bushing.

8 Claims, 5 Drawing Sheets

(56) References Cited

U.S. PATENT DOCUMENTS

| | | | | |
|---|---|---|---|---|
| 8,925,167 | B1 * | 1/2015 | Miller | B25B 27/023 254/20 |
| 9,364,945 | B1 * | 6/2016 | Lander | B25B 27/06 |
| 2008/0028588 | A1 * | 2/2008 | Rubino | B25B 27/02 29/426.5 |
| 2012/0036689 | A1 * | 2/2012 | Sjosten | B25B 27/0064 29/256 |
| 2018/0009093 | A1 * | 1/2018 | Jung | B25B 27/0035 |

* cited by examiner

REPLACEMENT TOOL FOR DRIVESHAFT YOKE BUSHINGS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to couplings between an automotive transmission and driveshaft, and, more specifically, to a tool for replacing a center bushing mounted to a driveshaft yoke that receives a transmission spigot.

One commonly used type of coupling between an automotive transmission output and a driveshaft may include a yoke carrying a center bushing which receives a transmission spigot. The bushing is press fit into a central bushing bore in the yoke. The bushing may be a metal cylinder with a flexible seal installed in its interior for conforming to the spigot.

During vehicle usage, the bushing may sometimes become cracked or otherwise damaged so that it needs to be replaced. Because the bushing is press fit and has a smooth outer surface, removal can be very difficult and there is a lack of useful tools available to perform the removal and subsequent installation of a new bushing. In some cases, attempts have been made to remove a bushing by drilling holes in the bushing and plying it out or otherwise applying sideways forces to remove the bushing. Consequently, removal of the bushing has been a difficult, time-consuming process which often causes damage to the yoke and/or driveshaft. In order to avoid the trouble of replacing the bushing, the entire driveshaft assembly is often replaced with a new one. This leads to increased cost (e.g., warranty costs) and waste.

It would be desirable to replace driveshaft yoke bushings in an efficient and productive manner without causing harm to the driveshaft or the yoke.

SUMMARY OF THE INVENTION

In one aspect of the invention, a bushing replacement tool is reconfigurable to either remove an old bushing or install a new bushing. A guide fixture is configured to attach to a driveshaft yoke in a predetermined relation to a bushing bore for press fitting of the bushing. The guide fixture comprises a top plate having a guide chamber facing the bushing bore and a first threaded passage aligned with the guide chamber. A traveler comprises a plunger slidingly received in the guide chamber at one end and a sleeve member at the other end. The sleeve member includes a socket configured to receive the bushing. The plunger has a second threaded passage coaxially aligned with the first threaded passage, wherein the first threaded passage has a diameter greater than the second threaded passage. The sleeve member has a transverse shaft receiving a lock bolt or set screw for selectably capturing the bushing in the socket. A removal bolt is received in both passages when the tool is in a removal configuration, the removal bolt having a shaft matching the second threaded passage and a head for transmitting a force against the top plate. Turning of the removal bolt draws the traveler toward it and extracts the bushing. An installation bolt is received in the first threaded passage when the tool is in an installation configuration, the installation bolt having a shaft matching the first threaded passage. A push plug in the guide chamber when the tool is in an installation configuration transfers force from the installation bolt to the plunger during turning of the installation bolt to press a new bushing into the bushing bore.

DETAILED DESCRIPTION OF PREFERRED EMBODIMENTS

Figure 1:
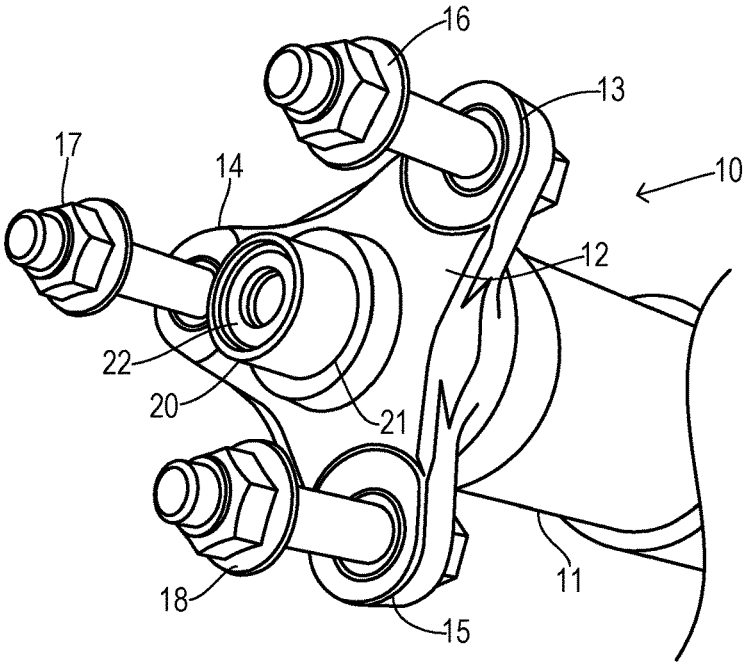
FIG. 1 is a perspective view of a yoke and bushing on the end of a driveshaft.

Referring to FIG. 1, a driveshaft assembly in includes a driveshaft 11 having a yoke 12 attached at one end in a conventional manner. Yoke 12 has separate lobes 13, 14, and 15 having respective bolt holes to connect yoke 12 to a transmission output (not shown), such as a flexible spacer and another yoke, using bolts 16, 17, and 18. A center bushing 20 is mounted in a bushing bore 21 at a center axis of yoke 12. A seal 22 contained within bushing 20 receives a transmission spigot (not shown). Bushing 20 is press fit within bore 21 as a result of a slight interference between the outside diameter of bushing 20 and the inside diameter of bore 21. In order to remove an old bushing and re-install a new bushing with minimal chance of damaging the yoke, the removal and installation should proceed axially, keeping the bushing parallel with the axis of bore 21.

Figure 2:
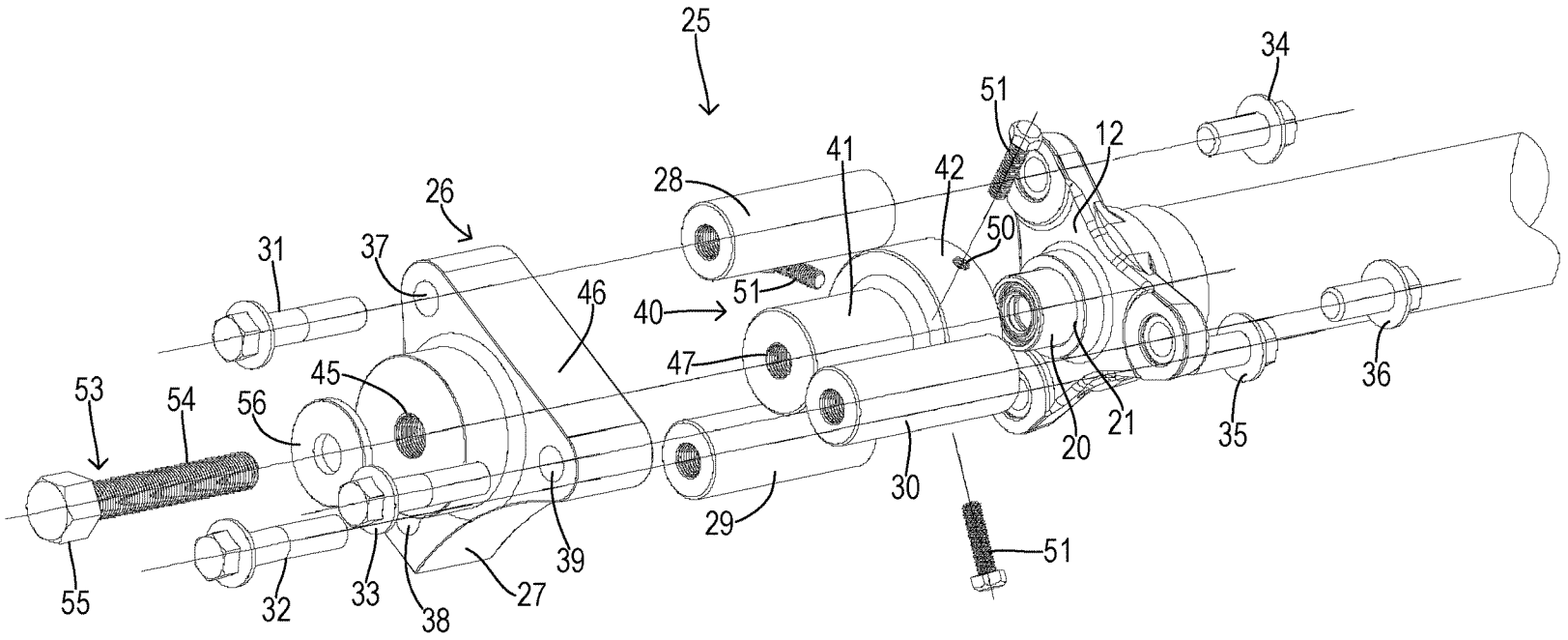
FIG. 2 is an exploded view of a tool of the invention in a removal configuration.

FIG. 2 shows a bushing replacement tool 25 in a configuration for axially extracting bushing 20. A guide fixture 26 includes a top guide plate 27 and a plurality of risers 28, 29, and 30 for coupling top plate 27 to yoke 12 using a plurality of fasteners 31-36. Fasteners 31-33 pass through apertures 37-39 in top plate 27 to engage threaded holes in risers 28-30. Similarly, bolts 34-36 pass through respective holes in the lobes of yoke 12 to fasten to risers 28-30 so that top plate 27 is fixed in a predetermined relationship with bushing bore 21 and bushing 20. Top plate 27 has a threaded passage 45 extending through plate 27 into a guide chamber 46 (seen in FIG. 3). Guide chamber 46 has a diameter D1 and threaded passage 45 has a diameter D2.

A traveler 40 includes a plunger 41 at one axial end and a sleeve number 42 at the other end. Plunger 41 has a diameter just slightly less than D1 of guide chamber 46 so that it is able to slide easily while maintaining accurate axial alignment. The axial lengths of chamber 46 and plunger 41 are sufficient to provide an axial movement greater than the press-fit distance of bushing 20 into bushing bore 21. Plunger 41 includes a threaded passage 47 aligned with passage 45 but having a smaller diameter.

Figure 4:
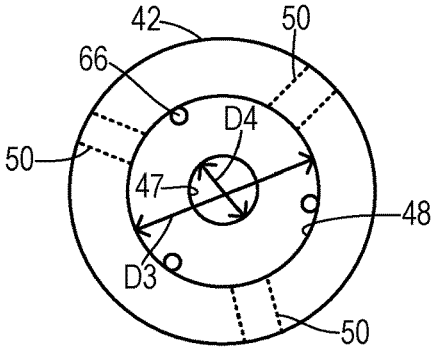
FIG. 4 is an end view of one embodiment for a traveler of the invention.

Sleeve member 42 includes a socket 48 for receiving the bushing as shown in FIG. 4. Socket 48 has a diameter D3 selected to create a slight pressure on the bushing to allow a replacement bushing to be manually inserted and then held in proper orientation during the initial stages of installation while allowing easy extraction of traveler 40 after full bushing installation. Sleeve member 42 further includes transverse shafts 50 which are threaded to receive lock bolts (e.g., set screws) 51 to rigidly secure a bushing within socket 48 during removal of an old bushing. Threaded passage 47 has a diameter D4 smaller than diameter D2 of threaded passage 45. As used in the removal configuration shown in FIG. 2, a removal bolt 53 has a threaded shaft 54 matching the threads of passage 47 and has a head 55 sized to react against top plate 27 via a washer 56. Since threaded shaft 54 has a matching diameter D4 matching passage 47, its diameter is less than diameter D2 of passage 45 so that there is no interaction with the threads of passage 45.

Figure 5:
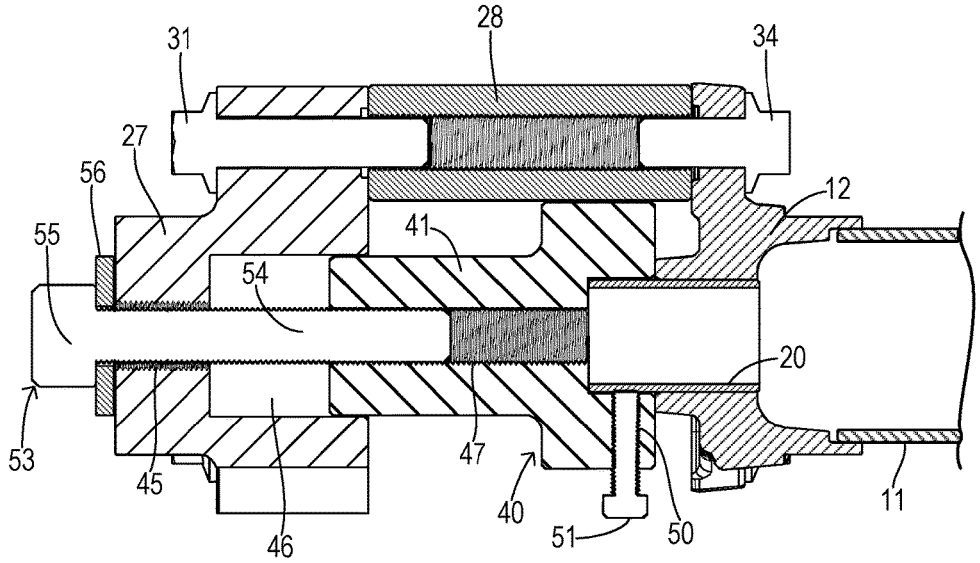
FIG. 5 is a cross-sectional view of the tool of FIG. 2 set up in the removal configuration prior to removing the bushing.
Figure 6:
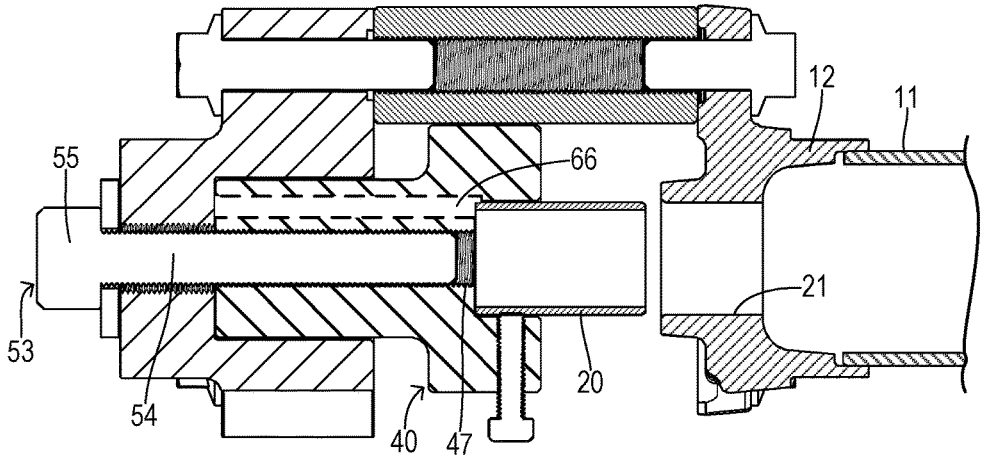
FIG. 6 is a cross-sectional view of the tool of FIG. 2 set up in the removal configuration after removing the bushing.

The process for removal of a bushing with tool 25 in the removal configuration is shown in FIGS. 5 and 6. For extraction, locking bolts 51 are tightened in shafts 50 in order to strongly press against an outer surface of bushing 20 with tool 25 positioned as shown in FIG. 5. The tips set screws/bolts 51 which engage bushing 20 preferably have a dog point machined on them in order to help maintain a grip on bushing 20. An optional keyed feature (not shown) could be provided between plunger 41 and guide chamber 46 in order to align transverse shafts 50 in the gaps between adjacent risers for easy access to lock bolts 51. However, a keyed feature may increase difficulty of assembling the tool and could impede movement as a result of the torsional stresses during bushing removal or installation.

Figure 3:
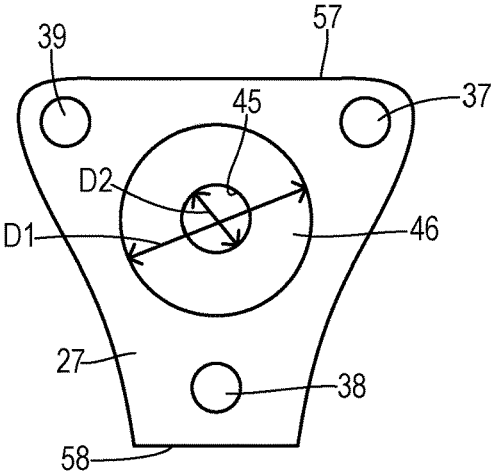
FIG. 3 is an end view of one embodiment for a top plate of the invention.

In the removal configuration, removal bolt 53 is threaded into passage 47 so that head 55 engages top plate 27 via washer 56. With continued clockwise rotation of removal bolt 53 (e.g., by turning head 55 using a power tool), force is transmitted between guide fixture 26 and traveler 40 such that plunger 41 is drawn into guide chamber 46 as shown in FIG. 6. Thus, bushing 20 has been axially extracted from bore 21 without any damage to yoke 12. In order to assist in keeping tool 25 in a fixed position during the operation of bolt 53, top plate 27 preferably includes parallel, planar surfaces 57 and 58 on opposite edges of plate 27 as shown in FIG. 3 to allow tool 25 to be secured in a vice.

After bushing 20 has been extracted, tool 25 is disassembled and lock bolts 51 are loosened in order to remove bushing 20 from socket 48. In the event that any deformation of bushing 20 causes it to be jammed, it could be forced out using knockout holes such as a hole 66 (FIGS. 4 and 6) which may be drilled through the body of traveler 40 in order to push out the jammed bushing via a rod inserted into the holes. One or more knockout holes could also enter radially from the side of socket 48, similar to transverse shafts 50 but located at the base of socket 48 and preferably having a larger diameter. Such a radial knockout hole could also be threaded in order to provide an anti-rotation bolt. In another alternative embodiment, traveler 40 could be a two-piece construction with plunger 41 and sleeve member 42 as separate components bolted together, so that they could be unbolted to allow the bushing to be pushed out.

Figure 7:
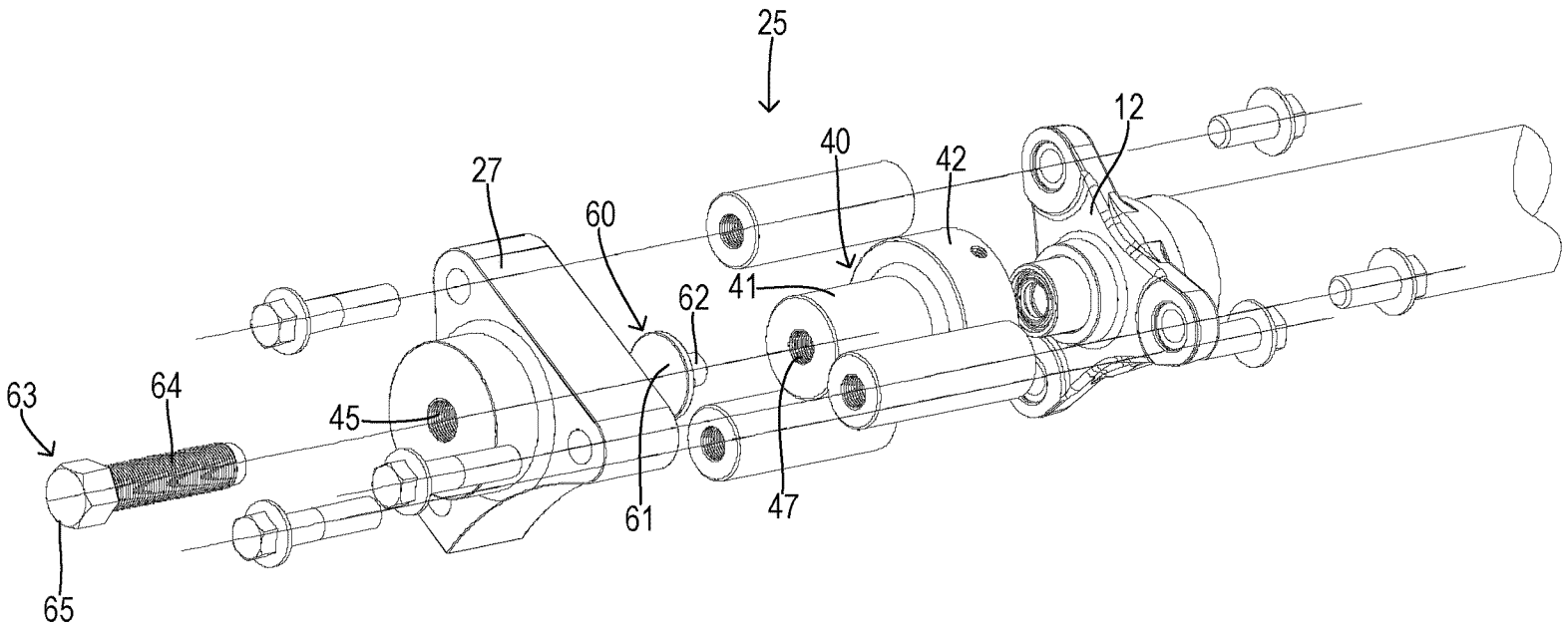
FIG. 7 is an exploded view of a tool of FIG. 2 in an installation configuration.

Tool 25 is shown in its installation configuration in FIG. 7. A push plug 60 comprises a pin 62 extending from disk or flange 61. Pin 62 is adapted to fit into threaded passage 47. Pin 62 is preferably unthreaded and has a diameter less than threaded passage 47 in order to allow free rotation. In addition, disk 61 may preferably be lubricated to assist in its rotation as described below.

Figure 8:
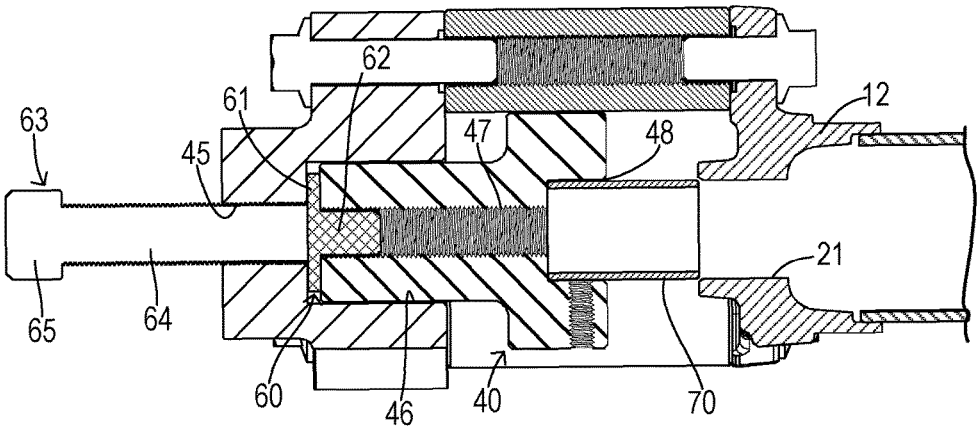
FIG. 8 is a cross-sectional view of the tool of FIG. 2 set up in the installation configuration prior to inserting the bushing.
Figure 9:
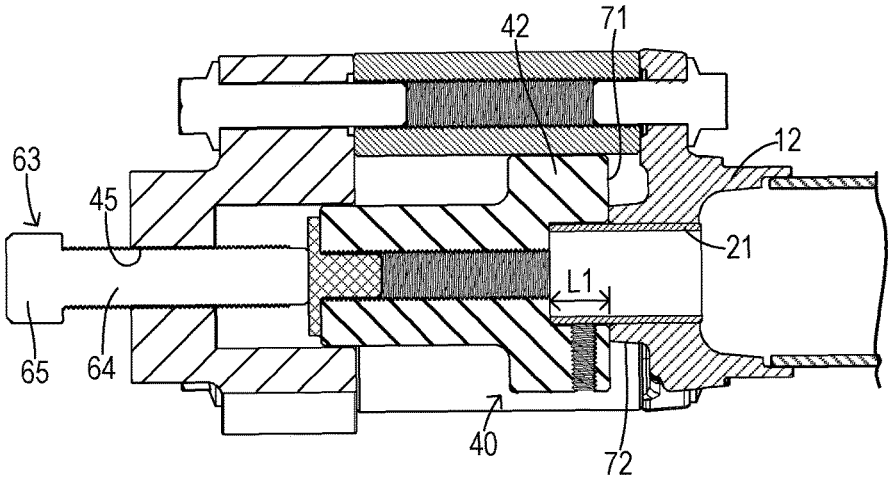
FIG. 9 is a cross-sectional view of the tool of FIG. 2 set up in the installation configuration after inserting the bushing.

An installation (i.e., drive) bolt 63 has a threaded shaft 64 and a head 65. Threaded shaft 64 has threads matching threaded passage 45. As shown in FIG. 8, installation bolt 63 is threaded into passage 45 with push plug 60 mounted in passage 47 of traveler 40. A new replacement bushing 70 is inserted into socket 48, and plunger 41 with push plug 60 is placed into guiding chamber 46. Thus, bushing 70 is held in alignment with bushing bore 21. Threaded shaft 64 is brought to bear against disk 61. Using clockwise rotation of head 65 (e.g., using a power tool), installation bolt 63 is displaced toward push plug 60 into chamber 46. As a result, traveler 40 is displaced toward yoke 12 so that bushing 70 is press fit into bushing bore 21. In addition to lubrication of push plug 60, installation bolt 63 should be very smooth on its end so that the end does not gall disk 61.

Sleeve member 42 has a leading edge 71 that eventually comes into contact with a surface on yoke 12 (such as a collar 72) which stops further penetration of bushing 70 into bushing bore 21. Socket 48 has a depth equal to an extension distance L1, which controls the length of bushing 70 that extends out from yoke 12 (simultaneously controlling the press-fit distance into bushing bore 21). Thereafter, tool 25 is disassembled and traveler 40 is pulled off of bushing 70 without disturbing the press fit.

The illustrated embodiment of the bushing replacement tool is specifically adapted to a particular bushing diameter and press-fit distance and to a particular configuration of the yoke attachment holes. In order to utilize the tool with different driveshaft yokes having other bushing sizes, press-fit distances, or mounting requirements, apertures 37-39 for receiving the fastening bolts could be formed as radial slots to accommodate different sizes of yokes. The socket in the traveler sleeve member could provide a stepped diameter to receive bushings of different lengths and diameters, or multiple travelers could be provided with different socket sizes.

What is claimed is:

1. A bushing replacement tool comprising:

a guide fixture configured to attach to a driveshaft yoke in a predetermined relation to a bushing bore for press fitting of a bushing, wherein the guide fixture comprises a top plate having a guide chamber facing the bushing bore and a first threaded passage aligned with the guide chamber;

a traveler comprising a plunger slidingly received in the guide chamber at one end and a sleeve member at the other end, wherein the sleeve member includes a socket configured to receive the bushing, wherein the plunger has a second threaded passage coaxially aligned with the first threaded passage, wherein the first threaded passage has a diameter greater than the second threaded passage, wherein the sleeve member has a transverse shaft receiving a lock bolt for selectably capturing the bushing in the socket;

a removal bolt received in the first threaded passage and the second threaded passage when the tool is in a removal configuration, the removal bolt having a shaft matching the second threaded passage and a head for transmitting a force against the top plate in response to rotation in the second threaded passage;

an installation bolt received in the first threaded passage when the tool is in an installation configuration, the installation bolt having a shaft matching the first threaded passage; and a push plug in the guide chamber when the tool is in the installation configuration to transfer force from the installation bolt to the plunger in response to rotation of the installation bolt in the first threaded passage.

2. The tool of claim 1, wherein the guide fixture further comprises a plurality of risers adapted to couple the top plate to the yoke using a plurality of fastening bolts.

3. The tool of claim 1, wherein the socket has an axial depth adapted to provide a predetermined press-fit distance for installing the bushing into the bushing bore.

4. The tool of claim 1, wherein the push plug is comprised of a disk and a pin extending from the disk into the second threaded passage, wherein the push plug rotates freely around an axis of the second threaded passage.

5. The tool of claim 1, wherein the guide fixture includes parallel, planar surfaces on opposite edges adapted to secure within a vice.

6. A tool for replacing bushings in a driveshaft yoke aperture comprising:

a fixed member attachable to the yoke having a bore aligned with the aperture;

a movable member slidable in the bore and having set screws for grasping a bushing within an internal socket;

a respective threaded passage in each member wherein a bolt turned within the passages extracts the bushing, and another bolt turned only within the fixed member passage inserts a new bushing.

7. The tool of claim 6 further comprising a lubricated push plug between the members to transfer force from the another bolt to the movable member.

8. The tool of claim 6, wherein the threaded passage in the fixed member has a larger diameter than the threaded passage in the movable member.

* * * * *